US008178275B2

(12) United States Patent
Tani et al.

(10) Patent No.: US 8,178,275 B2
(45) Date of Patent: May 15, 2012

(54) METHOD FOR PRODUCING POLYMERIZED TONER, POLYMERIZED TONER, METHOD FOR PRODUCING BINDER RESIN FOR TONER AND BINDER RESIN FOR TONER

(75) Inventors: Atsushi Tani, Suntou-gun (JP); Norikazu Fujimoto, Susono (JP); Hitoshi Itabashi, Yokohama-shi (JP)

(73) Assignee: Canon Kabushiki Kaisha, Tokyo (JP)

( * ) Notice: Subject to any disclaimer, the term of this patent is extended or adjusted under 35 U.S.C. 154(b) by 275 days.

(21) Appl. No.: 12/593,637

(22) PCT Filed: May 16, 2008

(86) PCT No.: PCT/JP2008/059495

§ 371 (c)(1),
(2), (4) Date: Sep. 29, 2009

(87) PCT Pub. No.: WO2008/143335

PCT Pub. Date: Nov. 27, 2008

(65) Prior Publication Data

US 2010/0119965 A1 May 13, 2010

(30) Foreign Application Priority Data

May 21, 2007 (JP) ..... 2007-133847

(51) Int. Cl.
*G03G 5/00* (2006.01)

(52) U.S. Cl. ..... 430/137.15; 264/4.7

(58) Field of Classification Search ..... 430/137.15; 264/4.7

See application file for complete search history.

(56) References Cited

U.S. PATENT DOCUMENTS

| | | | | |
|---|---|---|---|---|
| 5,278,020 | A | 1/1994 | Grushkin et al. | 430/137 |
| 5,665,506 | A * | 9/1997 | Kashima et al. | 430/137.17 |
| 6,218,065 | B1 | 4/2001 | Tanikawa et al. | |
| 6,221,287 | B1 | 4/2001 | Podszun et al. | 264/4.7 |
| 7,153,625 | B2 | 12/2006 | Kaburagi et al. | |
| 2005/0238984 | A1 | 10/2005 | Kaburagi et al. | 430/109.1 |
| 2008/0286675 | A1 | 11/2008 | Tani et al. | 430/105 |

FOREIGN PATENT DOCUMENTS

| | | | |
|---|---|---|---|
| CN | 1229198 | A | 9/1999 |
| EP | 0 964 002 | A1 | 12/1999 |
| JP | 61-114245 | | 5/1986 |
| JP | 07-181731 | | 7/1995 |
| JP | 8-272137 | A | 10/1996 |
| JP | 10-020548 | | 1/1998 |
| KR | 10-2007-0029162 | A | 3/2007 |

OTHER PUBLICATIONS

Official Action dated May 25, 2011 in Chinese Application No. 200880016721.4.

Chinese Office Action dated Nov. 23, 2011 in Chinese Application No. 200880016721.4.

* cited by examiner

*Primary Examiner* — Mark A Chapman

(74) *Attorney, Agent, or Firm* — Fitzpatrick, Cella, Harper & Scinto

(57) ABSTRACT

The present invention provides a method for producing a toner that can suppress the production of the decomposition products derived from a polymerization initiator, and can suppress the remaining presence, in the toner particles, of the unreacted polymerizable monomer and decomposition product residues. On the basis of this method, the present invention provides a toner that is excellent in triboelectric charging stability and can yield stable images over a long term. The present invention provides a method for producing a polymerized toner including a step of producing a polymerized toner particle by dispersing in an aqueous medium a polymerizable monomer composition including at least a polymerizable monomer and a colorant and by polymerizing the polymerizable monomer by using a polymerization initiator in the aqueous medium, the method being characterized in that the polymerization initiator has a structure represented by the following General Formula:

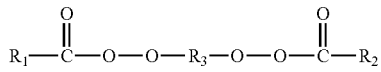

(wherein $R_1$ and $R_2$ each independently represent an optionally branched or substituted aliphatic hydrocarbon group having 1 to 6 carbon atoms, and $R_3$ represents an optionally branched aliphatic hydrocarbon group having 3 to 12 carbon atoms).

13 Claims, No Drawings

METHOD FOR PRODUCING POLYMERIZED TONER, POLYMERIZED TONER, METHOD FOR PRODUCING BINDER RESIN FOR TONER AND BINDER RESIN FOR TONER

TECHNICAL FIELD

The present invention relates to a method for producing a toner used for forming a toner image by developing an electrostatic latent image formed by a method such as an electrophotographic method, an electrostatic recording method and a toner jet recording method, or to a method for producing a binder resin for use in toner.

BACKGROUND ART

Various methods are known as an image forming method based on the electrophotographic method. In general, by using a photoconductive substance, an electrostatic latent image is formed on an electrostatic image carrying member (hereinafter, also referred to as "photosensitive member") by using various techniques. Then, by developing with a toner, the electrostatic latent image is converted into a visible image, and the visible image formed with the toner is transferred onto a recording medium such as paper, according to need, and thereafter fixed as a toner image on the recording medium by heat or pressure to yield a copy. Examples of the image forming machines for forming such a copy include printers and copying machines.

In these years, as printer apparatuses, LED laser beam printers become the mainstream in the market, and the resolution has become higher as seen in transition from conventional resolutions of 300 dpi and 400 dpi to higher resolution of 600 dpi and 1200 dpi. Accordingly, the development method has been required to be higher in definition. Copying machines have also become increasingly higher in performance through digitalization, and have been required to involve development methods higher in resolution and definition similarly to printers.

Usually, the toners used in these printers and copying machines are microparticles including as main constituent materials a binder resin and colorants such as dyes, pigments, carbon black and magnetic materials, and toners of approximately 5 to 30 μm in particle size are used.

A toner is generally produced by a so-called pulverizing method in which in a thermoplastic resin as a binder resin, the above-described colorants and, according to need, a charge controlling agent and a wax are melt-mixed so as to be uniformly dispersed, and thereafter the thus obtained resin composition is finely pulverized and classified to obtain desired particle sizes. In this method for producing a toner, the prerequisites to be satisfied by the constituent materials include, for example, a point that the resin composition should be sufficiently brittle and be able to be finely pulverized with an economically feasible production apparatus. However, when the brittleness of the resin composition is made higher, there occurs a problem that the particle size range of the particles obtained by fine pulverization tends to be broadened. Additionally, caused is a problem that even after completion of the toner production, the toner tends to be further finely pulverized while being used in the development unit, and the colorants are exposed to the fracture surface of the toner particles to cause the degradation of the developability.

On the other hand, for the purpose of overcoming the problems of the toner based on such a pulverizing method, a method for producing a polymerized toner by means of a suspension polymerization method has been proposed. The suspension polymerization method is a method in which a polymerizable monomer composition, including a polymerizable monomer and the substances required to be encapsulated in the toner particle such as a colorant and, according to need, a multifunctional monomer, a chain transfer agent, a charge controlling agent and a wax dissolved or dispersed in the polymerizable monomer, is suspended in an aqueous medium containing a dispersion stabilizer as well as a polymerization initiator, and the suspension liquid is subjected to polymerization by means of a method such as heating to yield a toner as particles having a desired particle size. According to this method, no pulverization step is included, and hence the resin material is not required to have brittleness and even a soft resin material can be used. Additionally, the colorant is hardly exposed to the surface of the toner particles, and hence a toner particle uniform in frictional chargeability and excellent in durability can be obtained. Further, the classification step can also be omitted, and hence cost reduction effects such as energy saving, production time reduction and yield improvement become significant.

However, carbon black and some dyes and pigments used as the colorants include substances tending to inhibit the polymerization reaction. Additionally, in the polymerized toner produced by the suspension polymerization method or the resin produced by the suspension polymerization method, depending on the type of the used polymerization initiator, the unreacted polymerizable monomer may remain in the toner particles or the resin particles. When the amount of the remaining polymerizable monomer is too large, the charge amounts of the individual toner particles become nonuniform to facilitate fogging, and the contamination of the toner carrying member and the filming to the photosensitive member tend to be caused, and hence there is caused a problem that the image quality is degraded.

Additionally, the utilization efficiency of the polymerization initiator in the suspension polymerization method is not necessarily sufficient, and a part of the polymerization initiator is not involved in the polymerization reaction and may remain in the toner particles or the resin as decomposition product residues. The decomposition product residues are produced from the compounds in the reaction system other than the polymerization initiator through the hydrogen abstraction by the free radicals (radicals) produced by the decomposition of the polymerization initiator, and from the mutual disproportion and mutual recombination of the radicals; the decomposition product residues mainly include compounds such as alcohols, carboxylic acids and hydrocarbons. Among the decomposition products, low boiling point products can be distilled off by conducting, after polymerization, operations such as heating and pressure reduction, and water-soluble products can be eluted into aqueous media; however, relatively high molecular weight, high boiling point and slightly soluble compounds are hardly removable and consequently remain in the toner particles.

Such decomposition product residues also offer causes for the degradation of the charge stability and the degradation of the image quality in long term use, and offer a cause for the so-called high-temperature offset in which the molten toner tends to adhere to the heating roller at the time of development and the thus adhered toner contaminates a sheet to be fixed. Additionally, a large amount of production of such decomposition products gives rise to the decrease of the utilization efficiency of the polymerization initiator, and such decrease offers a cause for the increase of the amount of the unreacted polymerizable monomer.

There have hitherto been intensively carried out investigations for preventing the remaining presence, in the toner particles, of the decomposition product residues derived from the unreacted polymerizable monomer and the polymerization initiator; examples of such proposals include the following various methods.

For example, there has been proposed a method for producing a toner resin in which the content of the decomposition product residues derived from the polymerization initiator is reduced by using as a polymerization initiator a peroxide having a specific structure and a 10-hour half-life temperature of 120° C. or lower (see Japanese Patent Application Laid-Open No. S61-114245).

Additionally, there has been proposed a method for obtaining a toner resin in which the remaining presence of the unreacted monomer (polymerizable monomer) is suppressed by conducting the polymerization in the simultaneous presence of a polymerization initiator having a specific structure other than the structure of the above-described polymerization initiator and a 10-hour half-life temperature of 70° C. or higher and an additional polymerization initiator (see Japanese Patent Application Laid-Open No. H07-181731).

Further, for production of a polymerized toner for use in a nonmagnetic one-component developer, there has been proposed a method for producing a polymerized toner in which the amount of the decomposition products derived from the polymerization initiator and the amount of the remaining monomer (polymerizable monomer) are suppressed by using as a polymerization initiator a nonaromatic organic peroxide having a molecular weight of 250 or less and a 10-hour half-life temperature of from 60 to 85° C. and by conducting suspension polymerization at a polymerization temperature of from 75 to 100° C. (see Japanese Patent No. 3336862).

Of the above-described conventional art examples, the method disclosed in Japanese Patent Application Laid-Open No. S61-114245 uses an aliphatic organic peroxide as a polymerization initiator, examples of such a peroxide including, in particular, organic peroxides limited in the number of the carbon atoms of the aliphatic hydrocarbon group among common peroxycarbonate organic peroxides, monocarbonate organic peroxides, diacyl organic peroxides, dicarbonate organic peroxides. According to this method, the decomposition products derived from the polymerization initiator have relatively low molecular weights. Consequently, when a binder resin for use in toner is produced by using such a polymerization initiator on the basis of a solution polymerization method, the decomposition product residues are evaporated by high-temperature heating in the solvent removal step after polymerization and in a melt-kneading step in the toner preparation, and hence, as disclosed, the remaining presence of the decomposition product residues in the toner particles can be suppressed. However, when such a polymerization initiator is applied to the production of a suspension-polymerized toner, the above-described steps each involving a high temperature heating treatment are not included, and hence it is difficult to suppress the remaining presence of the decomposition product residues in the toner particles. Additionally, it has also been found difficult to suppress the polymerization inhibition due to some colorants.

The above-described method disclosed in Japanese Patent Application Laid-Open No. H07-181731 uses a polymerization initiator that produces radicals hardly causing hydrogen abstraction reaction in a step of producing a binder resin for use in toner. According to this method, the radicals can stably persist over a long period of time, and hence, as disclosed, the utilization efficiency of the monomer is improved, and the remaining presence of the unreacted monomer can be suppressed. However, this polymerization initiator has a high 10-hour half-life temperature and is not necessarily suitable as a polymerization initiator for use in the production of a suspension-polymerized toner. Additionally, this polymerization initiator produces other radicals as well as the radicals hardly causing hydrogen abstraction reaction, and further, another polymerization initiator is needed to be simultaneously used, and the effect of reducing the produced amounts of the decomposition product residues has been found small.

The above-described method disclosed in Japanese Patent No. 3336862 specifies, in the production of a polymerized toner based on a suspension polymerization method, the molecular weight and the 10-hour half-life temperature of the used polymerization initiator, and intends to thereby suppress the remaining presence of the decomposition product residues and the unreacted monomer. However, the physical properties of the decomposition products are not uniquely determined only by the molecular weight of the polymerization initiator, but are controlled by the molecular weights and the molecular structures of the decomposition products themselves. Also, the amount of the unreacted monomer is not simply determined only by the 10-hour half-life temperature of the polymerization initiator, but depends to a great degree on the balance between the 10-hour half-life temperature and the polymerization temperature. This method intends to suppress the remaining presence of the decomposition product residues in the toner particles, but not to suppress the production itself of the decomposition products. According to the investigation by the present inventors, this method still has room to be improved with respect to the remaining presence of the decomposition product residues and the unreacted monomer.

As described above, as affairs stand now, with respect to the polymerized toner produced by a suspension polymerization method, there have never been developed production methods that can solve various problems caused by the remaining presence of the unreacted polymerizable monomer and the decomposition product residues in the toner particles.

An object of the present invention is to provide a method for producing a toner and a method for producing a binder resin for use in toner that have solved the above-described conventional problems.

In other words, the object of the present invention is to improve the utilization efficiency of the polymerization initiator used in the production of the toner or the binder resin for use in toner.

Additionally, another object of the present invention is to provide a production method that can reduce the effects of the polymerization inhibiting substances.

Additionally, another object of the present invention is to provide a production method that can suppress the remaining presence, in the toner particles, of the decomposition product residues derived from the unreacted polymerizable monomer and the polymerization initiator.

Additionally, another object of the present invention is to provide, by using the above-described production method, a toner or a binder resin for use in toner that is excellent in triboelectric charging stability and can yield stable images over a long term.

DISCLOSURE OF THE INVENTION

The present invention is a method for producing a polymerized toner including a step of producing a polymerized toner particle by dispersing in an aqueous medium a polymerizable monomer composition including at least a polymerizable monomer and a colorant and by polymerizing the polymerizable monomer by using a polymerization initiator in the aqueous medium, the method being characterized in that the polymerization initiator has a structure represented by the following General Formula (1):

General Formula (1)

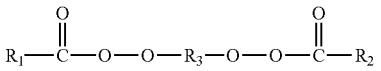

(wherein $R_1$ and $R_2$ each independently represent an optionally branched or substituted aliphatic hydrocarbon group having 1 to 6 carbon atoms, and $R_3$ represents an optionally branched aliphatic hydrocarbon group having 3 to 12 carbon atoms).

Additionally, the present invention relates to a method for producing a binder resin for use in toner including a step of polymerizing a polymerizable monomer by using at least a polymerization initiator, the method being characterized in that the polymerization initiator has the structure represented by the above-described General Formula (1).

Further, the present invention relates to a polymerized toner or a binder resin for use in toner produced by the above described methods.

According to the present invention, the effects of the polymerization inhibiting substances are suppressed and the utilization efficiency of the polymerization initiator can be improved.

Additionally, according to the present invention, there can be obtained a toner in which suppressed is the remaining presence of the decomposition product residues derived from the unreacted polymerizable monomer and the polymerization initiator. Also, there can be obtained a toner that is excellent in triboelectric charging stability and can yield stable images over a long term.

BEST MODES FOR CARRYING OUT THE INVENTION

Hereinafter, the preferred embodiments of the present invention are presented and the present invention is described in more detail.

The present inventors found that a polymerization initiator having a specific structure hardly undergoes polymerization inhibition in the production of a polymerized toner obtained by dispersing a polymerizable monomer composition in an aqueous medium and by polymerizing a polymerizable monomer in the concomitant presence of a colorant by using a polymerization initiator in the aqueous medium. The present inventors have also found that by optimizing the constitution of the polymerization initiator, the utilization efficiency of the polymerization initiator can be largely improved, and the remaining presence, in the toner particles, of the unreacted polymerizable monomer and the decomposition product residues can be suppressed. By obtaining these findings, the present invention was perfected. The improvement of the utilization efficiency of the polymerization initiator is effective also in the production of a binder resin for use in toner.

Examples of typical production methods of the above-described polymerized toner may include a suspension polymerization method. The suspension polymerization method is a method in which a polymerizable monomer composition composed of a polymerizable monomer and a polymerization initiator, and according to need, additional ingredients such as a multifunctional monomer and a chain transfer agent is suspended in a dispersion stabilizer-containing aqueous medium to be granulated, and the granulated polymerizable monomer composition is subjected to polymerization by heating. According to this method, a toner particle can be directly produced by conducting polymerization in such a way that a colorant and other substances required to be contained in the toner particle are beforehand dissolved or dispersed in the polymerizable monomer composition.

The polymerized toner, produced by the suspension polymerization method, according to the present invention is produced as follows.

First, a polymerizable monomer composition is prepared in which a toner composition, namely, a composition including a polymerizable monomer to be a binder resin and at least a colorant to be added thereto is uniformly dissolved or dispersed to prepare the polymerizable monomer composition with a dispersing machine such as a homogenizer, a ball mill, a colloid mill or an ultrasonic dispersing machine. In this preparation, in the polymerizable monomer composition, according to need, a multifunctional monomer, a chain transfer agent, a wax as a release agent, a charge controlling agent, a plasticizer, and further other additives (for example, a polymer and a dispersant) may be optionally added.

Next, the polymerizable monomer composition is suspended to be granulated in a beforehand prepared, dispersion stabilizer-containing aqueous medium. In this granulation, by granulating in a short time to a desired particle size with a high speed dispersing machine such as a high speed stirrer or an ultrasonic dispersing machine, the particle size distribution of the obtained toner particles can be sharpened.

The polymerization initiator may be mixed together with the other additives when the polymerizable monomer composition is prepared, or may be mixed in the polymerizable monomer composition immediately before the suspension in the aqueous medium. Alternatively, the polymerization initiator may also be added, during granulation or after completion of the granulation, namely, immediately before the start of the polymerization reaction, according to need, in a condition that the polymerization initiator is dissolved in the polymerizable monomer or in another solvent.

The polymerization reaction is conducted while the suspension liquid after granulation is being increased in temperature to a temperature of 50 to 90° C., and is being stirred so that the droplet particles in the suspension liquid may maintain the state of being particles, and neither flotation nor sedimentation of the particles may be caused.

The polymerization initiator is readily decomposed by heating due to temperature increase to produce free radicals (radicals). The produced radicals are added to the unsaturated bond of the polymerizable monomer to newly produce adduct radicals. The produced adduct radicals are further added to the unsaturated bond of the polymerizable monomer. The polymerization reaction proceeds by repeating such an addition reaction in a chain-like manner.

In the latter half of the polymerization reaction or after completion of the polymerization reaction, a part of the aqueous medium can also be distilled off from the reaction system in order to remove the unreacted polymerizable monomer or by-products.

Next, after completion of the polymerization reaction, the obtained polymer particles are filtered off with a heretofore known method, washed sufficiently and dried. Thus, the polymerized toner based on the suspension polymerization method is obtained.

In general, the inhibition of a polymerization reaction is caused by the presence of a substance extremely readily reacting with the radicals produced by the decomposition of the polymerization initiator. Some colorants function as polymerization inhibiting substances, and hence in the presence of such colorants, the direct reaction with the colorants becomes predominant rather than the addition reaction of the unsaturated bond of the polymerizable monomer, and the produced radicals are consumed to a large extent in this direct reaction to result in polymerization inhibition.

In the production of the polymerized toner, it has been found that such polymerization inhibition can be avoided by using as the polymerization initiator a bifunctional peroxy ester organic peroxide having a structure represented by the General Formula (1):

General Formula (1)

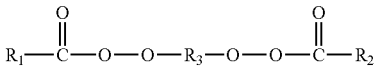

(wherein $R_1$ and $R_2$ each independently represent an optionally branched or substituted aliphatic hydrocarbon group having 1 to 6 carbon atoms, and $R_3$ represents an optionally branched aliphatic hydrocarbon group having 3 to 12 carbon atoms).

When the bifunctional peroxy ester organic peroxide is heated, as illustrated in the following Formula (a), the two O—O bonds are respectively cleaved and two or three types of radicals different in structure from each other (two types of acyloxy radicals may be the same in structure) are produced. The avoidance of the polymerization inhibition has been probably achieved due to the difference in the reactivity of these radicals to the polymerization inhibiting substances. In other words, due to the presence of the radical species exhibiting higher activity to the polymerization inhibiting substances, the other radical species less active to the polymerization inhibiting substances can probably contribute to the reaction with the polymerizable monomer without undergoing the effects of the polymerization inhibiting substances:

Formula (a)

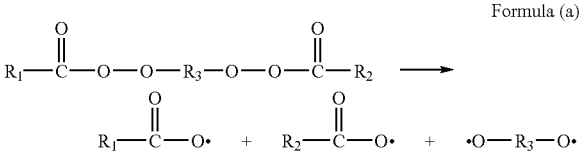

When the produced individual radicals abstract hydrogen atoms from the other compounds in the reaction system, the radicals are deactivated to newly produce carboxylic acids and diols. It is unpreferable for these products to remain in the toner particles as the decomposition product residues, and hence preferably these products are immediately discharged from the interior of the droplets into the dispersion medium.

When $R_1$ to $R_3$ in the Formula (1) are each an aromatic hydrocarbon group, it is difficult to discharge the produced carboxylic acids and diols from the interior of the droplets. Accordingly, from the viewpoint of the solubility, to the dispersion medium, of the carboxylic acids and diols, aliphatic hydrocarbon groups are used as $R_1$ to $R_3$. Additionally, $R_1$ and $R_2$ are each an optionally branched or substituted aliphatic hydrocarbon group, and each have 1 to 6 carbon atoms. As the substituents in $R_1$ and $R_2$, an OH group is possible. $R_3$ is an optionally branched aliphatic hydrocarbon group and has 3 to 12 carbon atoms.

For the purpose of essentially reducing the remaining presence of the decomposition product residues derived from the polymerization initiator, it is necessary to reduce the produced amount of the residues themselves, and for that purpose, it is important to suppress the above-described hydrogen atom abstraction reaction and efficiently utilize the radicals.

In the present invention, it has been found that the utilization efficiency of the radicals depends on the stability of the radicals and can be controlled by the molecular structure of the radicals. Thus, by optimizing the molecular structure of each of the radicals to establish a stability balance between the radicals, the utilization efficiency as the polymerization initiator has become able to be strikingly improved.

This is probably ascribable to the situation that when the stability differences between the produced radicals are large, the polymerization reaction associated with the more stable radical is predominant and the other radicals are predominantly involved in hydrogen atom abstraction so as to be incapable of being involved in the polymerization.

The peroxy ester organic peroxide is cleaved to produce an acyloxy radical and an alkoxy radical, and the utilization efficiency of the acyloxy radical is known to be usually higher than that of the alkoxy radical.

This is inferred to be caused by the following reason.

As the general reaction of the acyloxy radical, the decarboxylation reaction represented by the following Formula (b) is known. The decarboxylation reaction is said to proceed extremely readily because the stability of the newly produced alkyl radical "$R_1$." is higher than the stability of the original acyloxy radical. In other words, the polymerization proceeds in such a way that the addition reaction to the polymerizable monomer caused by this alkyl radical "$R_1$." becomes predominant.

Formula (b)

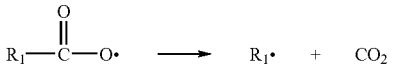

Accordingly, by suppressing to some extent the decarboxylation reaction of the acyloxy radical, the utilization of the counterpart alkoxy radical is promoted, and consequently the utilization efficiency of the polymerization initiator probably becomes able to be improved.

As for the stability of the alkyl radical, it is known that, for example, ethyl radical is more stable than methyl radical, and a secondary alkyl and a tertiary alkyl are more stable in this order as compared to a primary alkyl. This is due to the difference between the numbers of the C—H bonds located at the β-position in the alkyl radicals and is accepted to be ascribable to the resonance stabilization effect due to the hyperconjugation caused by the hydrogen atoms.

Specifically, by making $R_1$ and $R_2$ in the General Formula (1) have the structure represented by the following General Formula (2), the decarboxylation reaction can be appropriately suppressed, and the utilization efficiency as the polymerization initiator can be improved:

General Formula (2)

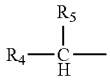

(wherein $R_4$ and $R_5$ each independently represent a hydrogen atom or a hydrocarbon group having 1 to 5 carbon atoms, and the total number of carbon atoms in the formula is 6 or less).

When $R_1$ and $R_2$ are secondary alkyl groups, the utilization efficiency can be more effectively improved. When $R_1$ and $R_2$ are primary alkyl groups, there is exhibited a tendency that the 10-hour half-life temperature of the polymerization initiator becomes too high. When $R_1$ and $R_2$ are tertiary alkyl groups, the stability of the produced alkyl radicals is too high, utilization of the alkoxy radicals cannot be promoted and hence the utilization efficiency of the polymerization initiator is degraded.

On the other hand, $R_3$ in the General Formula (1) is preferably made to have the structure represented by the following General Formula (3) particularly because the utilization efficiency of the polymerization initiator can thereby be effectively improved:

General Formula (3)

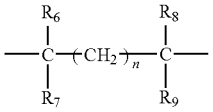

(wherein $R_6$ to $R_9$ each independently represent a hydrocarbon group having 1 or 2 carbon atoms, n is an integer of 1 to 3, and the total number of carbon atoms in the formula is 12 or less).

Usually, the alkoxy radical is low in stability, tends to cause the above-described hydrogen atom abstraction reaction, and hence exhibits a tendency that the utilization efficiency of the radical is lower than that of the acyloxy radical.

Detailed mechanism is not clear, but probably, by making $R_3$ have a structure represented by the above-described General Formula (3), the C—C bond cleavage (hereinafter referred to as the β-cleavage) reaction at the β-position to each of the oxygen atoms as shown in the following Formula (c) is made to occur readily. Thus, a newly produced highly stable alkyl radical (.$(CH_2)_n$.) readily undergoes the addition reaction to the polymerizable monomer, and hence the utilization efficiency of the polymerization initiator is probably improved.

Formula (c)

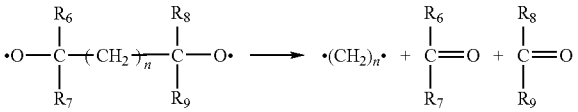

In the present invention, the 10-hour half-life temperature of the polymerization initiator preferably falls within a range from 50 to 80° C. When the 10-hour half-life temperature is lower than 50° C., the polymerization temperature is needed to be lowered in conformity with such a 10-hour half-life temperature, and thus a problem that the control of the molecular weight of the obtained binder resin is thereby made difficult tends to be caused. Additionally, when the polymerization temperature is inappropriate, the utilization efficiency of the polymerization initiator is degraded, and the amount of the unreacted polymerizable monomer and the produced amount of the decomposition product residues tend to be increased. On the other hand, when the 10-hour half-life temperature exceeds 80° C., the polymerization temperature is needed to be increased in conformity with such a 10-hour half-life temperature, and hence the production cost is raised. Additionally, when the polymerization temperature is not appropriately high, the utilization efficiency of the polymerization initiator is degraded, and hence the amount of the unreacted polymerizable monomer and the produced amount of the decomposition product residues are increased as the case may be.

Specific examples of the polymerization initiator satisfying the above-described conditions include the following compounds, and these can be suitably used:

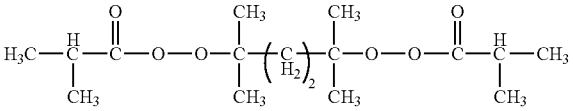

2, 5-di (isobutyrylperoxy)-2, 5-dimethylhexane

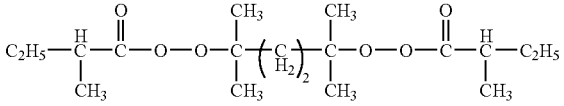

2, 5-di (2-methylbutyrylperoxy)-2, 5-dimethylhexane

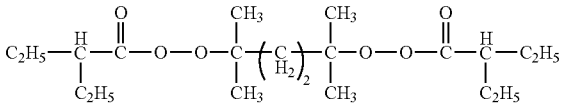

2, 5-di (2-ethtylbutyrylperoxy)-2, 5-dimethylhexane

And, the used amount of the polymerization initiator preferably falls within a range from 0.5 to 10 parts by mass in relation to 100 parts by mass of the polymerizable monomer. When the used amount of the polymerization initiator falls within the above-described range, the amount of the unreacted polymerizable monomer and the produced amount of the decomposition product residues can be suppressed, and additionally, the control of the molecular weight of the obtained resin is facilitated.

As described above, the present invention specifies the structure of the polymerization initiator used in the production of a toner, from the viewpoint of the stability of the radicals produced from the polymerization initiator. On the basis of a new effect of the drastic improvement of the utilization efficiency provided by this structure specification, the present invention intends to realize a toner in which the remaining presence, in the toner particles, of the unreacted polymerizable monomer and the decomposition product residues is suppressed.

In other words, a mere specification of the molecular weight (or the number of carbon atoms) and the 10-hour half-life temperature of the polymerization initiator can hardly achieve the object of the present invention.

The polymerization initiator according to the present invention is particularly effective when applied to the production of a polymerized toner by the suspension polymerization method susceptible to the effects of polymerization inhibiting substances, and also can provide similar effects when applied to the production of a binder resin for use in toner.

Under such circumstances as described above, according to the present invention, the effects of the polymerization inhibiting substances can be suppressed and the utilization efficiency of the polymerization initiator can be improved in the production of a polymerized toner or a binder resin for use in toner. Accordingly, the remaining presence, in the toner particles, of the unreacted polymerizable monomer and the decomposition product residues derived from the polymerization initiator can be suppressed.

Additionally, by using such a production method, there can be realized a toner which is excellent in triboelectric charging stability and can yield stable images over a long term.

Examples of the polymerizable monomer usable in the present invention include the following: styrene; styrene monomers such as α-methylstyrene, o-methylstyrene, m-methylstyrene, p-methylstyrene, p-methoxystyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylic acid esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, phenyl acrylate and 2-hydroxyethyl acrylate; methacrylic acid esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, 2-hydroxyethyl methacrylate, dimethylaminoethyl methacrylate and diethylaminoethyl methacrylate; and acrylonitrile, methacrylonitrile and acrylamide.

These polymerizable monomers can be used each alone or as mixtures thereof. Among these monomers, styrene or styrene derivatives are preferably used each alone or as mixtures with other monomers from the viewpoint of the development properties and the durability of the toner.

In the present invention, a chain transfer agent can also be used according to need. Examples of such a chain transfer agent include: alkylmercaptans such as n-pentylmercaptan, isopentylmercaptan, 2-methylbutylmercaptan, n-hexylmercaptan, n-heptylmercaptan, n-octylmercaptan, t-octylmercaptan, t-nonylmercaptan, n-dodecylmercaptan, t-dodecylmercaptan, n-tetradecylmercaptan, t-tetradecylmercaptan, n-pentadecylmercaptan, n-hexadecylmercaptan, t-hexadecylmercaptan and stearylmercaptan; alkyl esters of thioglycolic acid; alkyl esters of mercaptopropionic acid; halogenated hydrocarbons such as chloroform, carbon tetrachloride, ethylene bromide and carbon tetrabromide; and α-methylstyrene dimer.

These chain transfer agents are not necessarily needed to be used; however, when used, the preferable addition amount of such an agent is 0.05 to 3 parts by mass in relation to 100 parts by mass of the polymerizable monomer.

In the present invention, a small amount of a multifunctional monomer can also be used in combination. As the multifunctional monomer, compounds having two or more polymerizable double bonds are mainly used. Examples of such a multifunctional monomer include the following: aromatic divinyl compounds such as divinylbenzene and divinylnaphthalene; carboxylic acid esters having two double bonds such as ethylene glycol diacrylate, ethylene glycol dimethacrylate and 1,3-butanediol dimethacrylate; divinyl compounds such as divinylaniline, divinyl ether, divinyl sulfide and divinylsulfone; and compounds having three or more vinyl groups.

These multifunctional monomers are not necessarily needed to be used; however, when used, the preferable addition amount of such a multifunctional monomer is 0.01 to 1 part by mass in relation to 100 parts by mass of the polymerizable monomer.

In the suspension polymerization method of the present invention, as the dispersion stabilizer added to an aqueous medium, heretofore known surfactants, organic dispersants and inorganic dispersants can be used. Among these, the inorganic dispersants hardly produce ultrafine powders, hardly undergo stability destruction even when the polymerization temperature is varied, are easy in washing thereof, and hardly exert any adverse effects on the toner, and hence can be preferably used. Examples of the inorganic dispersants include the following: multivalent metal phosphates such as calcium phosphate, magnesium phosphate, aluminum phosphate and zinc phosphate; carbonates such as calcium carbonate and magnesium carbonate; inorganic salts such as calcium metasilicate, calcium sulfate and barium sulfate; hydroxides such as calcium hydroxide, magnesium hydroxide and aluminum hydroxide; and inorganic oxides such as silica, bentonite and alumina.

When these inorganic dispersants are used, these dispersants my be added as they are to an aqueous medium to be used; however, alternatively, for the purpose of obtaining further finer particles, compounds capable of producing the inorganic dispersants may be used to produce the particles of the inorganic dispersants in an aqueous medium to be used as the inorganic dispersants. For example, in the case of calcium phosphate, an aqueous solution of sodium phosphate and an aqueous solution of calcium chloride are mixed under high speed stirring, and thus water-insoluble calcium phosphate can be produced so as to permit more uniform and finer dispersion. In this mixing, water soluble sodium chloride is simultaneously by-produced; however, this by-production is more favorable because the presence of a water-soluble salt in the aqueous medium suppresses the dissolution of the polymerizable monomer into water and hence emulsified fine particles are hardly generated. The inorganic dispersant can be almost completely removed by dissolving the inorganic dispersant by adding an acid or an alkali after the completion of the polymerization.

Additionally, these inorganic dispersants are preferably used each alone in an amount of 0.2 to 20 parts by mass in relation to 100 parts by mass of the polymerizable monomer; however, according to need, 0.001 to 0.1 part by mass of a surfactant may also be used in combination. Examples of such a surfactant include the following: sodium dodecylbenzene sulfate, sodium tetradecyl sulfate, sodium pentadecyl sulfate, sodium octyl sulfate, sodium oleate, sodium laurate, sodium stearate and potassium stearate.

As the colorant used in the polymerized toner of the present invention, heretofore known colorants can be used.

Examples of black colorants may include carbon black and magnetic powders; alternatively, the following yellow/magenta/cyan colorants may be mixed together to provide black color.

Examples of yellow colorants include the following: condensed azo compounds, isoindolinone compounds, anthraquinone compounds, azo metal complexes, methine compounds and allylamide compounds; specifically, preferably used are C.I. pigment yellow 12, 13, 14, 15, 17, 62, 74, 83, 93, 94, 95, 109, 110, 111, 128, 129, 147, 168 and 180.

Examples of the magenta colorants to be used include condensed azo compounds, diketopyrolopyrrole compounds, anthraquinone, quinacridone compounds, basic dye lake compounds, naphthol compounds, benzimidazolone compounds, thioindigo compounds and perylene compounds; specifically, preferably used are C.I. pigment red 2, 3, 5, 6, 7, 23, 48:2, 48:3, 48:4, 57:1, 81:1, 122, 144, 146, 166, 169, 177, 184, 185, 202, 206, 220, 221 and 254.

Examples of the cyan colorants to be used include copper phthalocyanine compounds and the derivatives thereof, anthraquinone compounds and basic dye lake compounds; specifically, preferably used are C.I. pigment blue 1, 7, 15, 15:1, 15:2, 15:3, 15:4, 60, 62 and 66.

These colorants can be used each alone or as mixtures thereof, and further, can be used in a state of solid solution. When a magnetic powder is used as a black colorant, the addition amount thereof is preferably 40 to 150 parts by mass in relation to 100 parts by mass of the polymerizable monomer. When carbon black is used as a black colorant, the addition amount thereof is preferably 1 to 20 parts by mass in relation to 100 parts by mass of the polymerizable monomer. For color toners, these colorants are selected on the basis of the hue angle, chromaticness, color brightness, weatherability, OHP transparency, and dispersibility in toner, and the preferable addition amount thereof is 1 to 20 parts by mass in relation to 100 parts by mass of the polymerizable monomer.

When these colorants are used in a polymerized toner based on the suspension polymerization method, attention should be paid to the transferability into the water phase as well as the above-described polymerization inhibition, and according to need, a surface modification such as hydrophobization is preferably conducted. Preferable examples of the dye colorant surface treatment include a method in which a polymerizable monomer is beforehand polymerized in the presence of the dye, and the obtained colored polymer is added to the monomer composition. For carbon black, in addition to the above-described treatment for a dye, a graft treatment may be conducted by using a substance reactive with the surface functional groups of carbon black such as polyorganosiloxane.

The magnetic powder is mainly composed of iron oxides such as triiron tetraoxide and γ-iron oxide, and generally has hydrophilicity. Owing to the interaction with water as the dispersion medium, the magnetic powder tends to be located preferentially on the surface of the particles, and owing to the magnetic powder exposed to the particle surface, the obtained toner particle comes to have a poor fluidity and a poor uniformity in triboelectric charging. Accordingly, a uniform hydrophobization treatment is preferably applied to the surface of the magnetic powder with a coupling agent. Examples of the usable coupling agents include a silane coupling agent and a titanium coupling agent, in particular, a silane coupling agent.

The toner of the present invention is preferably made to encapsulate therein a release agent in order to improve the fixability. Examples of the usable release agents include the following: petroleum waxes such as paraffin wax, microcrystalline wax and petrolatum and the derivatives thereof; montan wax and the derivatives thereof; hydrocarbon waxes based on the Fischer-Tropsch method and the derivatives thereof; polyolefin wax typified by polyethylene and the derivatives thereof; and natural waxes such as carnauba wax and candelilla wax and the derivatives thereof. The derivatives include oxides, block copolymers with vinyl monomers and substances graft-modified with vinyl monomers. Further, the following can also be used: higher aliphatic alcohols; fatty acids such as stearic acid and palmitic acid or compounds thereof; acid amide waxes; ester waxes; ketones; hydrogenated castor oil and the derivatives thereof; plant waxes; and animal waxes. These release agents may be used each alone and in combinations of two or more thereof.

Preferable among these release agents are the release agents having a maximum heat absorption peak in a region from 40 to 130° C. at the time of temperature increase in the DSC curve measured with a differential scanning calorimeter, and more preferable are the release agents having the concerned maximum peak in a region from 45 to 120° C. By using such a release agent, a large contribution to the low temperature fixability is achieved, and the releasability can also be effectively developed. Additionally, the bleeding of the release agent is suppressed except for at the time of fixing, and the degradation of the chargeability can be suppressed. Additionally, the compatibility between the high temperature offset resistance and the low temperature fixability can be satisfactorily achieved. Further, at the time of production, there can hardly occur a problem that the release agent component is deposited during granulation to make nonuniform the dispersion of the release agent in the particles.

The content of the release agent is preferably 1 to 30 parts by mass, and more preferably 3 to 20 parts by mass in relation to the binder resin. When the content of the release agent falls within the above-described range, sufficient addition effects can be attained, and a satisfactory offset resistance can be attained. Also when falling within the above-described range, dispersion of the other toner ingredients is not disturbed and the bleeding of the release agent component can be suppressed, and hence the fluidity and the storage stability can be satisfactorily maintained over a long term.

Additionally, in the production of a polymerized toner by the suspension polymerization method, polymerization may be conducted by adding a polymer having a polarity in the above-described polymerizable monomer composition. A monomer containing a hydrophilic group such as an amino group, a carboxyl group, a hydroxyl group, a glycidyl group or a nitrile group has hitherto found difficulty in being used because such a monomer is dissolved in the aqueous suspension to cause emulsion polymerization. However, by converting such a hydrophilic group-containing monomer into a form of a random copolymer, a block copolymer or a graft copolymer with a vinyl compound such as styrene or ethylene, such a hydrophilic group-containing monomer can be introduced into the toner; alternatively, by converting into a form of a polycondensate such as polyester or polyamide or a form of a polyaddition polymer such as polyether or polyimine, such a hydrophilic group-containing monomer can also be introduced into the toner.

For example, polyester is a resin that contains a large number of ester bonds and is relatively higher in polarity. When polymerization is conducted by adding such polyester to the polymerizable monomer composition, polyester exhibits a tendency to migrate to the surface layer of the polymerizable monomer composition particles in an aqueous dispersion medium, and hence with the progress of the polymerization, polyester tends to be preferentially located on the surface portion of the particles. Consequently, the obtained toner particles become uniform in surface state and in surface composition, the uniformity of the triboelectric charging is improved, and the above-described encapsulation of the release agent also becomes stronger. Accordingly, a polymerized toner satisfactory both in developability and in blocking resistance can be obtained.

As polyester resin, for example, for the purpose of controlling the triboelectric chargeability, durability and fixability of the toner, saturated polyester resin, unsaturated polyester resin, and both of these resins can be appropriately selected to be used.

As the polyester, usual polyesters containing as the constituent components at least an alcohol component and an acid component can be used.

Examples of the dihydric alcohols include the following: ethylene glycol, 1,2-propylene glycol, 1,3-propylene glycol, 1,4-butanediol, 1,3-butanediol, 2,3-butanediol, diethylene glycol, dipropylene glycol, triethylene glycol, 1,5-pentanediol, 1,6-hexanediol, 1,4-cyclohexanediol, neopentyl glycol, 2,2,4-trimethylpentane-1,3-diol, polyethylene glycol, polypropylene glycol, polytetramethylene glycol, bisphenol A, hydrogenated bisphenol A, or the bisphenol derivatives represented by the following General Formula (4), and the diols represented by the following General Formula (5):

General Formula (4)

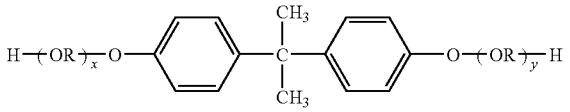

(wherein R is an ethylene or propylene group, x and y are each an integer of 1 or more, and the average value of x+y is 2 to 10), General Formula (5)

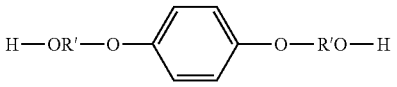

(wherein R' is —$CH_2CH_2$—, —$CH_2CH(CH_3)$— or —$CH_2$—$C(CH_3)_2$—).

Examples of the trihydric or higher alcohols include the following: sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

These alcohol components may be used each alone or in mixed states thereof.

Examples of the dicarboxylic acid include the following: dicarboxylic acids such as naphthalene dicarboxylic acid, phthalic acid, isophthalic acid, terephthalic acid, maleic acid, fumaric acid, citraconic acid, itaconic acid, succinic acid, adipic acid, sebacic acid and azelaic acid; dicarboxylic acid anhydrides such as phthalic anhydride and maleic anhydride; and lower alkyl esters of dicarboxylic acids such as dimethyl terephthalate, dimethyl maleate and dimethyl adipate. Particularly preferable are lower alkyl esters of dicarboxylic acids such as dimethyl terephthalate, dimethyl maleate and dimethyl adipate or the derivatives of these esters.

Additionally, by using tricarboxylic or higher acids, crosslinking may be formed. Examples of the tricarboxylic or higher acids include the following: trimellitic acid, tri-n-ethyl 1,2,4-benzene tricarboxylate, tri-n-butyl 1,2,4-benzene tricarboxylate, tri-n-hexyl 1,2,4-benzene tricarboxylate, triisobutyl 1,2,4-benzene tricarboxylate, tri-n-octyl 1,2,4-benzene tricarboxylate and tri-2-ethylhexyl 1,2,4-benzene tricarboxylate.

To an extent that the properties of polyester resin are not impaired, a monocarboxylic acid component and a monohydric alcohol component may be used. Examples of the monocarboxylic acid components include the following: benzoic acid, naphthalenecarboxylic acid, salicylic acid, 4-methylbenzoic acid, 3-methylbenzoic acid, phenoxyacetic acid, biphenylcarboxylic acid, acetic acid, propionic acid, butyric acid, octanoic acid, decanoic acid, dodecanoic acid and stearic acid. Examples of the monohydric alcohol components include the following: n-butanol, isobutanol, sec-butanol, n-hexanol, n-octanol, lauryl alcohol, 2-ethylhexanol, decanol, cyclohexanol, benzyl alcohol and dodecyl alcohol.

Additionally, with the aim of improving the dispersibility and fixability of the materials and the image properties, polymers other than the above-described polymers may be added to the polymerizable monomer composition. For example, homopolymers of styrene and the substitution products thereof such as polystyrene and polyvinyltoluene and styrene copolymers can be used each alone or as mixtures thereof.

Further, when a polymer having a molecular weight falling outside the molecular weight range of the binder resin obtained by polymerizing the polymerizable monomer is beforehand dissolved in the polymerizable monomer composition and then polymerization is conducted, a polymerized toner having a broad molecular weight distribution and being satisfactory in offset resistance can be obtained.

The addition amount of such a polymer preferably falls within a range from 1 to 20 parts by mass in relation 100 parts by mass of the polymerizable monomer. When the addition amount falls within the above-described range, sufficient addition effects are obtained and the effects on the design of various physical properties can be made small.

Additionally, the toner of the present invention may be made to contain a charge controlling agent, according to need, for the purpose of stabilizing the charging properties. Examples of the method for making the toner contain the charge controlling agent include a method in which the charge controlling agent is added to the interior of the toner particles and a method in which the charge controlling agent is externally added to the toner particles. As the charge controlling agent, heretofore known charge controlling agents can be used; however, when the charge controlling agent is internally added in the production of the polymerized toner, particularly preferable is a charge controlling agent which is low in polymerization inhibition and contains substantially no substances soluble in the aqueous dispersion medium. Specific examples of such compounds as the negative charge controlling agents include the following: metal compounds of aromatic carboxylic acids such as salicylic acid, alkylsalicylic acid, dialkylsalicylic acid, naphthoic acid and dicarboxylic acid; metal salts or metal complexes of azo dyes or azo pigments; polymeric compounds having sulfonic acid groups or carboxylic acid groups in the side chains thereof; and boron compounds, urea compounds, silicon compounds and calixarenes. Additionally, specific examples of such compounds as the positive charge controlling agents include the following: quaternary ammonium salts, polymeric compounds having the quaternary ammonium salts in the side chains thereof, guanidine compounds, nigrosine compounds and imidazole compounds.

The used amounts of these charge controlling agents are determined according to the toner production method involving the type of the binder resin, the presence and absence of other additives and the dispersion method, and hence is not uniquely limited; however, in the case of internal addition, the used amount of each of these charge controlling agents is preferably falls within a range from 0.1 to 10 parts by mass and more preferably within a range from 0.1 to 5 parts by mass in relation to 100 parts by mass of the binder resin. In the case of external addition, the used amount of each of these charge controlling agents is preferably 0.005 to 1.0 part by mass and more preferably 0.01 to 0.3 part by mass in relation 100 parts by mass of the toner particle.

The weight average particle size of the toner obtained according to the present invention is preferably 3.0 to 10.0 μm for the purpose of developing with fidelity the finer dots of electrostatic latent images to yield high-quality images.

In this connection, the average particle size and the particle size distribution of a toner can be measured with a Coulter Counter model TA-II or a Coulter Multisizer (both manufactured by Coulter Inc.). In the present invention, a Coulter Multisizer is used, and connected to an interface (manufactured by Nikkaki Co., Ltd.) to output the number distribution and the volume distribution and to a personal computer PC9801 (manufactured by NEC Corp.). As an electrolyte, a 1% aqueous solution of NaCl prepared by using a first-grade sodium chloride is used.

In the measurement method, a surfactant as a dispersant, preferably 0.1 to 5 ml of an alkylbenzenesulfonic acid salt is added to 100 to 150 ml of the electrolyte, and further, 2 to 20 mg of a measurement sample is added to the electrolyte. Then, the electrolyte is subjected to a dispersion treatment for approximately 1 to 3 minutes with an ultrasonic disperser, and subsequently subjected to a measurement in which by using the Coulter Multisizer, with a 100-μm aperture, the volume and the number of particles of 2 μm or more are measured to derive the volume distribution and the number distribution. From these distributions, the weight average particle size (D4) and the number average particle size (D1) are derived.

The average circularity of the toner obtained according to the present invention is preferably 0.970 or more. The average circularity is an index indicating the irregularity degree of the toner particle; the average circularity is 1.000 for a perfectly spherical toner, and becomes smaller with increasing complexity of the surface shape of a toner. In other words, an average circularity of 0.970 or more means that the toner shape is substantially spherical. A toner having such a shape tends to be uniformly charged, and is effective in suppression of fog and sleeve ghost; additionally, the toner ears formed on the toner carrying member tend to be uniform, and hence the control in a development section is facilitated; further, the toner also has a satisfactory fluidity owing to the spherical shape thereof, is hardly susceptible to stress in the development unit, and hence is hardly degraded in chargeability in a long term use under high humidities; and, also at the time of fixing, heat and pressure tend to be uniformly applied to the whole toner to contribute to the fixability improvement.

The average circularity in the present invention is measured with a flow particle image analyzer "FPIA-model 3000" (manufactured by Sysmex Corp.).

A specific measurement method is such that to 20 ml of ion-exchanged water, a surfactant as a dispersant, preferably, an appropriate amount of alkylbenzenesulfonic acid salt is added, and then 0.02 g of a measurement sample is added; the sample solution thus obtained is subjected to a dispersion treatment for 2 minutes with a desktop ultrasonic washer disperser (for example "VS-150" (manufactured by Velvo-Clear Co., Ltd.)) having an oscillating frequency of 50 kHz and an electrical output power of 150 W, to prepare a measurement dispersion liquid; in this case, the dispersion liquid is appropriately cooled so as to have a temperature of 10° C. or higher and 40° C. or lower.

In the measurement, the flow particle image analyzer mounted with a standard objective lens (magnification of 10) is used, and Particle Sheath "PSE-900A" (manufactured by Sysmex Corp.) is used as the sheath solution. A dispersion liquid prepared according to the above-described procedures is introduced into the flow particle image analyzer, subjected to a total count mode measurement of 3000 toner particles, and an average circularity of the toner is obtained with the analyzed particle sizes constrained to be circle corresponding diameters of 3.00 μm or more and 200.00 μm or less.

In the measurement, autofocus adjustment is conducted before measurement by using a standard latex particle (for example, 5200A manufactured by Duke Scientific Corp. is diluted with ion-exchanged water). Thereafter, the focus adjustment is preferably conducted every 2 hours from the start of the measurement.

In Examples, a flow particle image analyzer provided with a calibration certificate issued by Sysmex Corp. was used, and measurement was conducted under the measurement and analysis conditions specified at the time of the issue of the calibration certificate except that the analyzed particle sizes were constrained to be circle corresponding diameters of 3.00 μm or more and 200.00 μm or less.

For the purpose of improving image quality, preferably, the toner of the present invention is externally added with a fluidity improving agent. Preferably used as the fluidity improving agent are inorganic fine powders such as silicic acid fine powder, titanium oxide and aluminum oxide. These inorganic fine powders are preferably subjected to hydrophobization treatment with a hydrophobizing agent such as a silane coupling agent, a silicone oil or the mixtures of these.

The toner of the present invention can be used as it is as a one-component developer or as a two-component developer after having been mixed with a magnetic carrier. When used as a two-component developer, the average particle size of the carrier to be mixed with is preferably 10 to 100 μm, and the toner concentration in the two-component developer is preferably 2 to 15% by mass.

EXAMPLES

Hereinafter, the production method of the present invention is specifically described with reference to Examples.

Example 1

Preparation of Pigment Dispersed Paste:

Styrene: 78.0 parts by mass

Carbon black: 7.0 parts by mass

The above-described materials were sufficiently premixed in a vessel, and while the mixture thus obtained was being maintained at 20° C. or lower, the mixture was uniformly dispersed and mixed with an attritor (manufactured by Mitsui Miike Kakoki Co., Ltd.) for approximately 4 hours to prepare a pigment dispersed paste.

Preparation of Toner Particle:

In 1150 parts by mass of ion-exchanged water, 390 parts by mass of a 0.1 mol/liter aqueous solution of $Na_3PO_4$ was placed, the obtained mixture was heated to a temperature of 60° C. under stirring, thereafter 58 parts by mass of a 1.0 mol/liter aqueous solution of $CaCl_2$ was added to the mixture, and further the mixture was continuously stirred to prepare an aqueous medium containing a dispersion stabilizer including $Ca_3(PO_4)_2$.

On the other hand, to the pigment dispersed paste, the following materials were added, and the obtained mixture was dispersed and mixed with an attritor (manufactured by Mitsui Miike Kakoki Co., Ltd.) to prepare a polymerizable monomer composition.

N-Butyl Acrylate: 22.0 Parts by Mass

Divinylbenzene: 0.1 Part by Mass

Saturated polyester resin (terephthalic acid-propylene oxide-modified bisphenol A polycondensation polymer, weight average molecular weight (Mw): 20000, glass transition temperature (Tg): 60° C., acid number: 10 mg KOH/g): 8.0 parts by mass Charge Controlling Agent (BONTRON E-84 (Orient Chemical Co., Ltd.)): 1.0 Part by Mass The polymerizable monomer composition was heated to 60° C., and 12.0 parts by mass of an ester wax (main component: $C_{19}H_{29}COOC_{20}H_{41}$, maximum heat absorption peak temperature: 68.6° C.) was added to the polymerizable monomer composition, mixed and dissolved.

Next, in the obtained mixture, 5.0 parts by mass of 2,5-di(isobutyrylperoxy)-2,5-dimethylhexane was further added as a polymerization initiator and dissolved.

This mixture was placed in the aqueous medium, and the obtained mixture was stirred for 15 minutes at a temperature of 60° C. in a nitrogen atmosphere with a Clearmix (manufactured by M•Technique Co., Ltd.) at 10,000 rpm to be granulated.

Further, while the thus obtained suspension liquid was being stirred with a stir paddle, polymerization was carried out at a temperature of 84° C. for 10 hours. On completion of the reaction, the suspension liquid was cooled, added with hydrochloric acid to dissolve the dispersion stabilizer, thereafter filtered, washed with water and dried to yield toner particles.

On the other hand, at each time of 2 hours and 5 hours from the start of the polymerization and the completion of the polymerization, a fraction of the suspension liquid was sampled, and the amounts of the remaining styrene and n-butyl acrylate were measured with a gas chromatography measurement apparatus ("6890N" manufactured by Yokogawa Analytical Systems Inc.). From the obtained measurement results, the polymerization rate was derived and no polymerization inhibition was found to occur.

The remaining amounts of styrene and n-butyl acrylate were specifically measured as follows: the sampled suspension liquid fractions were diluted by adding acetone in an amount of 20 times to 50 times the volumes of the sampled suspension liquid fractions, treated with an ultrasonic disperser for approximately 30 minutes, filtered with a solvent-resistant 0.5 μm pore size membrane filter, and the filtrates thus obtained were measured.

With 10 parts by mass of hexamethyldisilazane, 100 parts by mass of a silica fine powder was treated, and further treated with 10 parts by mass of a silicone oil to prepare a hydrophobic silica fine powder which had a primary particle size of 12 nm and a BET specific surface area of 120 $m^2/g$. Subsequently, 1 part by mass of the hydrophobic silica fine powder was added to 100 parts by mass of the toner particles and mixed with a Henschel mixer (manufactured by Mitsui Miike Kakoki Co., Ltd.) to prepare a toner of the present invention.

Example 2

A toner was prepared in the same manner as in Example 1 except that 5.9 parts by mass of 2,5-di(2-ethylbutyrylperoxy)-2,5-dimethylhexane was used as a polymerization initiator in place of 5.0 parts by mass of 2,5-di(isobutyrylperoxy)-2,5-dimethylhexane in Example 1, and the temperature at the time of polymerization was increased to 89° C. in place of 84° C. in Example 1.

Comparative Example 1

A toner was prepared in the same manner as in Example 1 except that 5.0 parts by mass of t-butyl peroxyisobutyrate was used as a polymerization initiator in place of 5.0 parts by mass of 2,5-di(isobutyrylperoxy)-2,5-dimethylhexane in Example 1, and the temperature at the time of polymerization was increased to 94° C. in place of 84° C. in Example 1.

Comparative Example 2

A toner was prepared in the same manner as in Example 1 except that 6.8 parts by mass of 1,1,3,3-tetramethylbutyl peroxyisobutyrate was used as a polymerization initiator in place of 5.0 parts by mass of 2,5-di(isobutyrylperoxy)-2,5-dimethylhexane in Example 1, and the temperature at the time of polymerization was decreased to 73° C. in place of 84° C. in Example 1.

Comparative Example 3

A toner was prepared in the same manner as in Example 1 except that 6.8 parts by mass of t-butyl peroxy-2-ethylhexanoate was used as a polymerization initiator in place of 5.0 parts by mass of 2,5-di(isobutyrylperoxy)-2,5-dimethylhexane in Example 1, and the temperature at the time of polymerization was increased to 88° C. in place of 84° C. in Example 1.

Comparative Example 4

A toner was prepared in the same manner as in Example 1 except that 6.8 parts by mass of 2,5-di(2-ethylhexanoylperoxy)-2,5-dimethylhexane was used as a polymerization initiator in place of 5.0 parts by mass of 2,5-di(isobutyrylperoxy)-2,5-dimethylhexane in Example 1, and the temperature at the time of polymerization was increased to 88° C. in place of 84° C. in Example 1.

Comparative Example 5

A toner was prepared in the same manner as in Example 1 except that 6.1 parts by mass of 2,5-di(benzoylperoxy)-2,5-dimethylhexane was used as a polymerization initiator in place of 5.0 parts by mass of 2,5-di(isobutyrylperoxy)-2,5-dimethylhexane in Example 1, and the temperature at the time of polymerization was increased to 95° C. in place of 84° C. in Example 1.

In each of Example 2 and Comparative Examples 1 to 5, the addition amount of the polymerization initiator was adjusted so that the active oxygen quantity of the polymerization initiator in relation to the molar quantity of the polymerizable monomer may be the same as in Example 1.

Additionally, in each of Examples 1 and 2 and Comparative Examples 1 to 4, the polymerization temperature was set so as to be higher by 15° C. than the 10-hour half-life temperature of the used polymerization initiator.

Table 1 shows the structures and the physical properties of the polymerization initiators used in Examples 1 and 2 and Comparative Examples 1 to 5.

TABLE 1

| | Polymerization initiator | Number of O—O bond (s) | Number of carbon atoms $R_1$ | $R_2$ | $R_3$ | Molecular weight | 10-Hour half-life temperature (° C.) |
|---|---|---|---|---|---|---|---|
| Ex. 1 | 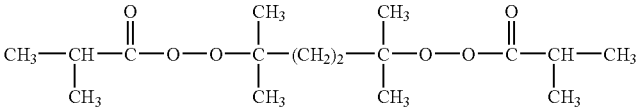 2,5-Di(isobutyrylperoxy)-2,5-dimethylhexane | 2 | 3 | 3 | 8 | 318 | 69 |
| Ex. 2 | 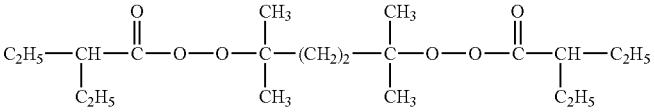 2,5-Di(2-ethylbutyrylperoxy)-2,5-dimethylhexane | 2 | 5 | 5 | 8 | 374 | 74 |
| Com. Ex. 1 | 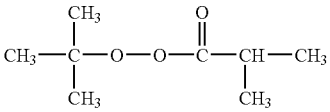 t-Butyl peroxyisobutyrate | 1 | 3 | — | 4 | 160 | 79 |
| Com. Ex. 2 | 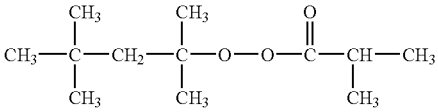 1,1,3,3-Tetramethylbutyl peroxyisobutyrate | 1 | 3 | — | 8 | 216 | 58 |
| Com. Ex. 3 | 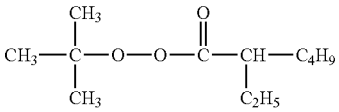 t-Butyl peroxy-2-ethylhexanoate | 1 | 7 | — | 4 | 216 | 73 |
| Com. Ex. 4 | 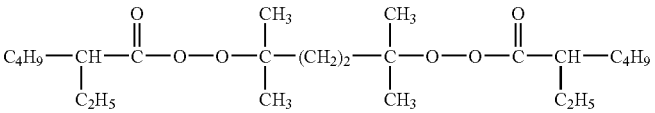 2,5-Di(2-ethylhexanoylperoxy)-2,5-dimethylhexane | 2 | 7 | 7 | 8 | 431 | 73 |
| Com. Ex. 5 | 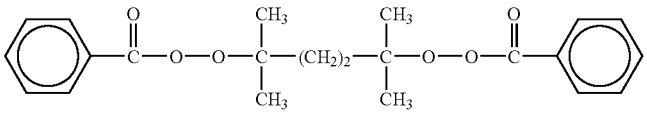 2,5-Di(benzoylperoxy)-2,5-dimethylhexane | 2 | 6 | 6 | 8 | 386 | 100 |

Note)

In the table, the numbers of carbon atoms respectively in $R_1$, $R_2$ and $R_3$ in the General Formula (1) are listed. Additionally, for the monofunctional initiators, the number of carbon atoms in $R_2$ is indicated with a blank (—).

For each of Example 2 and Comparative Examples 1 to 5, the polymerization rate was derived from the remaining amounts of styrene and n-butyl acrylate in the same manner as in Example 1, and consequently, Example 2 and Comparative Examples 1 to 4 were all found to be free from the occurrence of the polymerization inhibition. Comparative Example 5 was slow in polymerization rate conceivably because the polymerization temperature was inappropriate, and after the termination of the polymerization, a large amount of the polymerizable monomer remained, and hence no subsequent evaluations were conducted.

The possible decomposition products derived from the polymerization initiator used in Example 1 include the following compounds: 2,5-dimethyl-2,5-hexanediol as a by-product produced due to hydrogen abstraction by an alkoxy radical, and isobutyric acid as a by-product produced due to hydrogen abstraction by an acyloxy radical.

Additionally, the possible decomposition products derived from the polymerization initiator used in Comparative Example 1 include the following compounds: t-butyl alcohol as a by-product produced due to hydrogen abstraction by an alkoxy radical, and isobutyric acid as a by-product produced due to hydrogen abstraction by an acyloxy radical.

These alcohols and carboxylic acids are all high in water solubility, and are probably readily eluted into the dispersion medium when produced.

Accordingly, on the assumption that all the alcohols were eluted into the dispersion medium, the conversion rates of the alkoxy radicals to the alcohols were derived from the amounts of the alcohols in the dispersion medium after completion of the polymerization. Additionally, on the assumption that all the carboxylic acids were eluted into the dispersion medium, the conversion rates of the acyloxy radicals to the carboxylic acids were derived from the amounts of the carboxylic acids in the dispersion medium after completion of the polymerization. Then, the utilization ratio of the polymerization initiators were derived as follows. The results thus obtained are shown in Table 2.

<Conversion Rate to Alcohol, Conversion Rate to Carboxylic Acid, and Utilization Ratio of Polymerization Initiator>

After completion of the polymerization, a fraction of the slurry was sampled from the reaction vessel, filtered with a 0.5 μm pore size membrane filter, then the alcohol concentration and the carboxylic acid concentration in the filtrate were measured with the gas chromatography measurement apparatus. From the obtained concentrations, the alcohol amount and the carboxylic acid amount were obtained by calculation.

The conversion rate to alcohol and the conversion rate to carboxylic acid were derived from the obtained alcohol amount or the obtained carboxylic acid amount and from the used polymerization initiator amount on the basis of the following formula:

Conversion rate(%)=(alcohol or carboxylic acid amount(mol)/used polymerization initiator amount (mol))×100

Additionally, from the thus obtained values of the conversion rate to alcohol and the conversion rate to carboxylic acid, the radical utilization ratio was derived on the basis of the following formula, and was defined as the utilization ratio of the polymerization initiator:

Utilization ratio(%)=((100−conversion rate to alcohol)+(100−conversion rate to carboxylic acid))/2

It is to be noted that for any of the polymerization initiators used in Example 2 and Comparative Examples 2 to 4, the utilization ratio of the polymerization initiator cannot be estimated from such a method as described above because low water soluble, high molecular weight decomposition products such as 1,1,3,3-tetramethylbutyl alcohol and 2-ethylhexanoic acid are probably produced from such polymerization initiators.

TABLE 2

| | Conversion rate of alkoxy radical to alcohol (%) | Conversion rate of acyloxy radical to carboxylic acid (%) | Utilization ratio of polymerization initiator (%) |
|---|---|---|---|
| Example 1 | 10 | 8 | 91 |
| Comparative Example 1 | 75 | 3 | 61 |

As is clear from Table 2, in each of Examples of the present invention, the conversion rate of alkoxy radical to alcohol and the conversion rate of acyloxy radical to acid were both low, and the utilization ratio of the polymerization initiator was extremely high.

On the contrary, in Comparative Example 1, although the conversion rate of acyloxy radical to carboxylic acid was low, a greater part of alkoxy radical was converted to alcohol without being utilized, and consequently, the utilization ratio of the polymerization initiator was found to be low.

Next, the toner obtained in each of Examples 1 and 2 and Comparative Examples 1 to 4 was subjected to the measurements of the weight average particle size (D4), number average particle size (D1), average circularity and molecular weight (peak molecular weight Mp). The physical properties of the respective toners are shown in Table 3, the measurement methods of the average particle size and the average circularity being as described above.

Additionally, for the molecular weight (Mp) measurement, a gel permeation chromatography (GPC) measurement apparatus (HLC-8120GPC) manufactured by Tosoh Corp. was used, and the measurement was conducted as follows.

(Measurement of Molecular Weight (Mp))

First, a sample was immersed in THF, extracted so as for the resin component concentration to be 0.05 to 0.6% by mass, and the extraction solution was filtered with a solvent-resistant 0.5 μm pore size membrane filter to prepare a sample solution. Then, the columns were stabilized in a heat chamber set at 40° C., THF as a solvent was flowed at a flow rate of 1 ml/min in the columns maintaining this temperature, and 50 to 200 μl of the sample solution was injected into the columns to conduct the measurement.

In the derivation of the molecular weight of the sample, the molecular weight distribution possessed by the sample was determined by using a calibration curve prepared with monodisperse polystyrene standard samples, from the relation between the logarithmic values and the count numbers. It is appropriate to use, as the standard polystyrene samples, at least approximately 10 samples having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ manufactured by Pressure Chemical Co. or Tosoh Corp. As the detector, an RI (refractive index) detector was used. As the columns, for the purpose of accurately measuring the molecular weights falling in a range from $10^3$ to $2\times10^6$, a combination of a plurality of commercially available polystyrene gel columns was preferable; in the present invention, the measurement was conducted under the following conditions:

Columns: KF801, 802, 803, 804, 805, 806, 807 (manufactured by Shodex Co., Ltd.)

Column temperature: 40° C.

Solv.: THF

TABLE 3

| | Weight average particle size D4 (μm) | Number average particle size D1 (μm) | D4/D1 | Average circularity | Main peak molecular weight Mp |
|---|---|---|---|---|---|
| Example 1 | 6.5 | 5.5 | 1.18 | 0.985 | 38200 |
| Example 2 | 6.5 | 5.4 | 1.2 | 0.982 | 41000 |
| Comparative Example 1 | 6.8 | 5.1 | 1.33 | 0.973 | 40800 |
| Comparative Example 2 | 6.6 | 5.1 | 1.29 | 0.974 | 37800 |
| Comparative Example 3 | 6.7 | 5 | 1.34 | 0.973 | 38100 |
| Comparative Example 4 | 6.8 | 5.6 | 1.21 | 0.98 | 43300 |

As is clear from Table 3, the toners according to Examples of the present invention were each sharp in particle size distribution and each had a high circularity. On the other hand, the toners in Comparative Examples, in particular, the toners in Comparative Examples 1 to 3 were each broad in particle size distribution and also low in circularity.

Such differences in the particle size distribution and circularity were conceivably ascribable to the situation that a large amount of alcohols and carboxylic acids were produced in the polymerization steps in these Comparative Examples and eluted into the dispersion medium, and consequently, the granulation stability was impaired and emulsion particles tended to be formed.

Example 3

Preparation of Toner Particle:

In 300 parts by mass of ion-exchanged water, 0.2 part by mass of polyvinyl alcohol was dissolved to prepare an aqueous medium. On the other hand, 78.0 parts by mass of styrene, 22.0 parts by mass of n-butyl acrylate and 2.5 parts by mass of 2,5-di(isobutyrylperoxy)-2,5-dimethylhexane used in Example 1 as the polymerization initiator were mixed together to prepare a monomer composition. The monomer composition was placed in the aqueous medium and stirred for 15 minutes with a TK homomixer (manufactured by Tokushu Kika Kogyo Co., Ltd.) to prepare a suspension dispersion liquid.

In a nitrogen atmosphere, the suspension dispersion liquid was increased in temperature to 90° C. to start polymerization, and further maintained at this temperature for 24 hours to complete the polymerization reaction. After completion of the reaction, the suspension dispersion liquid was cooled, filtered off, washed with water and dried to yield the binder resin A for toner that was a styrene/n-butyl acrylate copolymer. Additionally, after completion of the reaction, a fraction of the slurry was sampled from the reaction vessel, and the conversion rate to alcohol, the conversion rate to carboxylic acid and the utilization ratio of the polymerization initiator were calculated according to the above-described methods. The results thus obtained are shown in Table 4.

To 100.0 parts by mass of the thus obtained binder resin A for toner, 7.0 parts by mass of Cu phthalocyanine (Pigment Blue 15:3), 1.0 part by mass of a nigrosine compound and 3.0 parts by mass of a paraffin wax (maximum value of heat absorption peak in DSC: 74° C.) were added and mixed together with a Henschel mixer. Then, the mixture thus obtained was melt kneaded with a double screw kneading extruder heated to 130° C., the kneaded mixture was cooled and then coarsely pulverized with a hammer mill, the coarsely pulverized substance was finely pulverized with a jet mill (manufactured by Nippon Pneumatic Mfg. Co., Ltd.), and the resulting finely pulverized substance was classified with a pneumatic classifier to yield a toner particle.

Further, 1 part by mass of the hydrophobic silica fine powder was added to 100 parts by mass of the toner particle in the same manner as in Example 1, and mixed with a Henschel mixer (manufactured by Mitsui Miike Kakoki Co., Ltd.) to yield a toner of the present invention.

The obtained toner was found to have a weight average particle size (D4) of 10.2 μm and an average circularity of 0.925.

Comparative Example 6

A toner was prepared in the same manner as in Example 3 except that t-butyl peroxy-2-ethylhexanoate used in Comparative Example 3 was used as a polymerization initiator in place of 2,5-di(isobutyrylperoxy)-2,5-dimethylhexane used in Example 3.

The obtained toner was found to have a weight average particle size (D4) of 11.1 μm and an average circularity of 0.920.

TABLE 4

| | Conversion rate of alkoxy radical to alcohol (%) | Conversion rate of acyloxy radical to carboxylic acid (%) | Utilization ratio of polymerization initiator (%) |
|---|---|---|---|
| Example 3 | 8 | 6 | 93 |

Each of the toners obtained in Examples 1 to 3, Comparative Examples 1 to 4 and Comparative Example 6 was subjected to an image forming test according to the following manner. The results thus obtained are shown in Table 5.

(Image Forming Test)

As a test printer, a modified printer of a commercially available full-color laser beam printer (LBP-2040, manufactured by Canon Corp.) was used. The process cartridge of the modified printer was filled with a toner, and a 5000-sheet image forming test was conducted at a print-out speed of 16 sheets/min (A4 size paper) in monochromatic mode in an environment of ordinary temperature and ordinary humidity (23° C., 60% RH) while the toner was being successively refilled as required; and the toner charge amount and image density on the toner carrying member were measured before and after the image formation.

Additionally, the toner carrying member was detached after the 5000-sheet image forming test and cleaned to remove the toner, and then the surface staining condition of the toner carrying member was observed with a microscope to be evaluated on the basis of the following standards.

A: No particular stain is identified.

B: Some stain is identified.

C: Melt adhesion of toner is identified.

TABLE 5

| | Charge amount (mC/kg) | | Image density | | |
|---|---|---|---|---|---|
| | Initial stage | After 5000-sheet image formation | Initial stage | After 5000-sheet image formation | Toner carrying member surface staining |
| Example 1 | −43.0 | −42.4 | 1.49 | 1.47 | A |
| Example 2 | −41.8 | −41.0 | 1.48 | 1.46 | A |
| Example 3 | −40.9 | −39.3 | 1.41 | 1.38 | A |
| Comparative Example 1 | −40.8 | −39.2 | 1.46 | 1.42 | A |
| Comparative Example 2 | −38.6 | −33.6 | 1.46 | 1.34 | B |
| Comparative Example 3 | −34.6 | −28.5 | 1.45 | 1.31 | C |
| Comparative Example 4 | −35.8 | −30.2 | 1.45 | 1.34 | C |
| Comparative Example 6 | −33.8 | −28.2 | 1.39 | 1.29 | C |

As shown in Table 5, each of the toners of Examples according to the present invention was found to have a satisfactory charging property from the initial stage and to maintain such a satisfactory charging property even after the 5000-sheet image formation. Consequently, the image density was also found to exhibit high values and to be stable throughout the durability test. Additionally, no staining on the surface of the toner carrying member was identified.

Now turning to the toners of Comparative Examples, the toners of Comparative Examples 2 to 4 and Comparative Example 6 were particularly found to be low in charging property from the initial stage and to be large in charging property degradation with the increase of the durability number of sheets. The image density degradation was also found to accompany the charging property degradation. Further, stains were identified on the surface of the toner carrying member after the 5000-sheet image formation. As conceivable from the above-described results, in each of the toners of these Comparative Examples, high molecular weight decomposition products derived from the initiator remained as decomposition product residues to adversely affect the toner performance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-133847, filed May 21, 2007, which is hereby incorporated by reference herein in its entirety.

The invention claimed is:

1. A method for producing a polymerized toner comprising producing a polymerized toner particle by dispersing in an aqueous medium a polymerizable monomer composition comprising at least a polymerizable monomer and a colorant and by polymerizing the polymerizable monomer by using a polymerization initiator in the aqueous medium, wherein:

the polymerization initiator has a structure represented by the following General Formula (1):

General Formula (1)

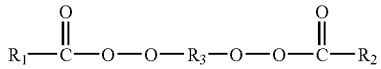

wherein $R_1$ and $R_2$ each independently represent an optionally branched or substituted aliphatic hydrocarbon group having 1 to 6 carbon atoms, and $R_3$ represents an optionally branched aliphatic hydrocarbon group having 3 to 12 carbon atoms.

2. The method for producing a polymerized toner according to claim 1, wherein $R_1$ and $R_2$ in the General Formula (1) each have a structure represented by the following General Formula (2):

General Formula (2)

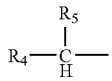

wherein $R_4$ and $R_5$ each independently represent a hydrogen atom or a hydrocarbon group having 1 to 5 carbon atoms, and the total number of carbon atoms in the formula is 6 or less.

3. The method for producing a polymerized toner according to claim 1, wherein $R_3$ in the General Formula (1) has a structure represented by the following General Formula (3):

General Formula (3)

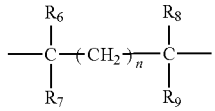

wherein $R_6$ to $R_9$ each independently represent a hydrocarbon group having 1 or 2 carbon atoms, n is an integer of 1 to 3, and the total number of carbon atoms in the formula is 12 or less.

4. The method for producing a polymerized toner according to claim 1, wherein the 10-hour half-life temperature of the polymerization initiator falls within a range from 50° C. to 80° C.

5. The method for producing a polymerized toner according to claim 1, wherein the used amount of the polymerization initiator is 0.5 parts by mass or more and 10 parts by mass or less in relation to 100 parts by mass of the polymerizable monomer.

6. A polymerized toner produced by the method according to claim 1.

7. A method for producing a binder resin for toner comprising polymerizing a polymerizable monomer by using at least a polymerization initiator, wherein:

the polymerization initiator has a structure represented by the following General Formula (1):

General Formula (1)

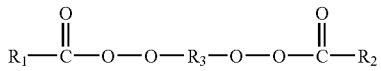

wherein $R_1$ and $R_2$ each independently represent an optionally branched or substituted aliphatic hydrocarbon group having 1 to 6 carbon atoms, and $R_3$ represents an optionally branched aliphatic hydrocarbon group having 3 to 12 carbon atoms.

8. The method for producing a binder resin for toner according to claim 7, wherein the polymerization of the polymerizable monomer by using the polymerization initiator comprises polymerizing the polymerizable monomer by dispersing the polymerizable monomer in an aqueous medium and by using the polymerization initiator in the aqueous medium.

9. The method for producing a binder resin for toner according to claim 7, wherein $R_1$ and $R_2$ in the General Formula (1) each have a structure represented by the following General Formula (2):

General Formula (2)

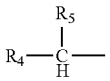

wherein $R_4$ and $R_5$ each independently represent a hydrogen atom or a hydrocarbon group having 1 to 5 carbon atoms, and the total number of carbon atoms in the formula is 6 or less.

10. The method for producing a binder resin for toner according to claim 7, wherein $R_3$ in the General Formula (1) has a structure represented by the following General Formula (3):

General Formula (3)

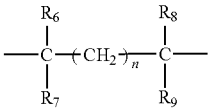

wherein $R_6$ to $R_9$ each independently represent a hydrocarbon group having 1 or 2 carbon atoms, n is an integer of 1 to 3, and the total number of carbon atoms in the formula is 12 or less.

11. The method for producing a binder resin for toner according to claim 7, wherein the 10-hour half-life temperature of the polymerization initiator falls within a range from 50° C. to 80° C.

12. The method for producing a binder resin for toner according to claim 7, wherein the used amount of the polymerization initiator is 0.5 parts by mass or more and 10 parts by mass or less in relation to 100 parts by mass of the polymerizable monomer.

13. A binder resin for toner produced by the method according to claim 7.

* * * * *